US012501933B2

(12) United States Patent
Papakyrillou

(10) Patent No.: US 12,501,933 B2
(45) Date of Patent: Dec. 23, 2025

(54) AEROSOL-GENERATING ARTICLE COMPRISING A HOLLOW TUBULAR SUPPORT ELEMENT

(71) Applicant: Philip Morris Products S.A., Neuchatel (CH)

(72) Inventor: Stefanos Papakyrillou, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 467 days.

(21) Appl. No.: 17/600,823

(22) PCT Filed: Apr. 3, 2020

(86) PCT No.: PCT/EP2020/059684
§ 371 (c)(1),
(2) Date: Oct. 1, 2021

(87) PCT Pub. No.: WO2020/201566
PCT Pub. Date: Oct. 8, 2020

(65) Prior Publication Data

US 2022/0175034 A1 Jun. 9, 2022

(30) Foreign Application Priority Data

Apr. 4, 2019 (EP) ..... 19167405

(51) Int. Cl.
*A24F 40/42* (2020.01)
*A24D 1/20* (2020.01)
(Continued)

(52) U.S. Cl.
CPC ..... *A24F 40/42* (2020.01); *A24D 1/20* (2020.01); *A24D 3/17* (2020.01); *A24F 40/70* (2020.01)

(58) Field of Classification Search
CPC ..... A24F 40/20; A24F 40/42; A24F 40/70; A24F 40/46; A24D 1/20; A24D 3/17;
(Continued)

(56) References Cited

U.S. PATENT DOCUMENTS 3,396,733 A 8/1968 Allseits et al.
3,860,011 A * 1/1975 Norman ..... A24D 3/0279 131/198.1
(Continued)

FOREIGN PATENT DOCUMENTS

CN 108024569 A 5/2018
CN 108567170 A 9/2018
(Continued)

OTHER PUBLICATIONS

Combined Russian Office Action and Search Report issued Jun. 14, 2023 in Russian Patent Application No. 2021130640/03 (with English Translation), 11 pages.
(Continued)

*Primary Examiner* — Hae Moon Hyeon
(74) *Attorney, Agent, or Firm* — Oblon, McClelland, Maier & Neustadt, L.L.P.

(57) ABSTRACT

An aerosol-generating article having an upstream end and a downstream end is provided, the article defining a longitudinal direction between the upstream end and the downstream end, the article including: an aerosol-forming substrate; a hollow tubular support element disposed downstream of the substrate and extending along the longitudinal direction, defining an opening extending in the longitudinal direction and configured for aerosol to flow towards the downstream end, a filter disposed downstream of the hollow tubular support element in the longitudinal direction, a hardness of the article at the hollow tubular support element is at least about 80%, and the hardness of
(Continued)

the article at the hollow tubular support element is determined by the DD60A Test. An aerosol-generating system is also provided.

15 Claims, 3 Drawing Sheets

(51) Int. Cl.
*A24D 3/17* (2020.01)
*A24F 40/70* (2020.01)

(58) Field of Classification Search
CPC .... A24D 3/0279; A24D 1/045; A24C 5/1885; B29C 45/00; B33Y 80/00
USPC ..... 131/329
See application file for complete search history.

(56) References Cited

U.S. PATENT DOCUMENTS

| | | | | |
|---|---|---|---|---|
| 5,020,548 | A | 6/1991 | Farrier et al. | |
| 5,692,525 | A | 12/1997 | Counts et al. | |
| 8,915,255 | B2 * | 12/2014 | Poget | A24B 15/165 131/365 |
| 10,028,531 | B2 * | 7/2018 | Clements | A61M 15/0028 |
| 10,939,701 | B2 * | 3/2021 | Lisan | A24D 3/0275 |
| 11,154,088 | B2 * | 10/2021 | Kadiric | A24D 1/02 |
| 11,219,244 | B2 * | 1/2022 | Dube | A24D 1/08 |
| 11,576,429 | B2 * | 2/2023 | Knight | A24B 15/283 |
| 12,059,026 | B2 * | 8/2024 | Cheong | A24D 3/10 |
| 2006/0174901 | A1 * | 8/2006 | Karles | A24D 3/061 131/337 |
| 2010/0024834 | A1 * | 2/2010 | Oglesby | A24F 42/60 131/194 |
| 2010/0059070 | A1 * | 3/2010 | Potter | A24F 42/60 131/194 |
| 2012/0255569 | A1 * | 10/2012 | Beard | A24D 3/061 131/342 |
| 2013/0025611 | A1 * | 1/2013 | Rushforth | A24D 3/16 131/332 |
| 2013/0139834 | A1 * | 6/2013 | Karlsson | B01J 20/268 131/297 |
| 2014/0137881 | A1 * | 5/2014 | Branton | A24D 3/066 493/43 |
| 2014/0202479 | A1 * | 7/2014 | Nicholls | A24D 3/048 131/337 |
| 2014/0224268 | A1 * | 8/2014 | Ryter | A24D 3/068 493/39 |
| 2014/0345634 | A1 * | 11/2014 | Zuber | A24D 3/17 131/328 |
| 2015/0001148 | A1 * | 1/2015 | Pan | B01D 39/18 426/77 |
| 2015/0163859 | A1 * | 6/2015 | Schneider | H05B 1/0244 219/535 |
| 2016/0106147 | A1 * | 4/2016 | Lisan | A24D 3/04 |
| 2016/0128378 | A1 * | 5/2016 | Kuersteiner | A24D 3/04 131/331 |
| 2017/0360087 | A1 * | 12/2017 | Papakyrillou | A24D 3/10 |
| 2018/0042303 | A1 * | 2/2018 | Buehler | B29D 99/0053 |
| 2018/0338522 | A1 * | 11/2018 | Delgado | A24D 3/04 |
| 2020/0085095 | A1 * | 3/2020 | Gnan | A24D 3/17 |
| 2020/0205468 | A1 * | 7/2020 | Nappi | A24D 1/20 |
| 2020/0329758 | A1 * | 10/2020 | Bonici | A24D 3/14 |
| 2022/0175022 | A1 * | 6/2022 | Papakyrillou | A24D 3/17 |
| 2022/0175034 | A1 * | 6/2022 | Papakyrillou | A24F 40/42 |
| 2022/0183347 | A1 * | 6/2022 | Hepworth | A24D 3/061 |
| 2022/0183351 | A1 * | 6/2022 | Forster | A24D 3/048 |
| 2023/0042993 | A1 * | 2/2023 | D'Ambra | A24D 1/20 |

FOREIGN PATENT DOCUMENTS

| | | | |
|---|---|---|---|
| CN | 208192123 | U | 12/2018 |
| CN | 109512022 | A | 3/2019 |
| CN | 208624630 | U | 3/2019 |
| EP | 2 910 134 | A1 | 8/2015 |
| EP | 3 039 972 | A1 | 7/2016 |
| EP | 3 075 272 | A2 | 10/2016 |
| EP | 3 494 809 | A1 | 6/2019 |
| EP | 3586652 | A1 | 1/2020 |
| GB | 2 082 042 | A | 3/1982 |
| JP | 2016-523528 | A | 8/2016 |
| JP | 2019-97 | A | 1/2019 |
| JP | 2019-506868 | A | 3/2019 |
| KR | 10-2018-0070516 | A | 6/2018 |
| KZ | 32356 | B | 9/2017 |
| WO | WO 2012/164009 | A2 | 12/2012 |
| WO | WO 2013/098409 | A1 | 7/2013 |
| WO | WO 2014/068295 | A1 | 5/2014 |
| WO | WO 2014/118286 | A2 | 8/2014 |
| WO | WO 2014/198815 | A1 | 12/2014 |
| WO | WO 2015/082648 | A1 | 6/2015 |
| WO | WO 2015/082651 | A1 | 6/2015 |
| WO | WO 2015/082652 | A1 | 6/2015 |
| WO | WO 2015/124242 | A1 | 8/2015 |
| WO | WO 2016/042100 | A1 | 3/2016 |
| WO | WO 2016/042101 | A1 | 3/2016 |
| WO | WO 2017/036586 | A1 | 3/2017 |
| WO | WO 2017/036588 | A1 | 3/2017 |
| WO | WO 2018/110834 | A2 | 6/2018 |
| WO | WO 2018/163253 | A1 | 9/2018 |
| WO | WO 2018/176346 | A1 | 10/2018 |
| WO | WO 2018/189201 | A1 | 10/2018 |
| WO | WO 2019/130155 | A1 | 7/2019 |
| WO | WO 2020/025737 | A1 | 2/2020 |
| WO | WO 2020/089105 | A1 | 5/2020 |
| WO | WO 2021/170650 | A1 | 9/2021 |
| WO | WO 2021/170651 | A1 | 9/2021 |
| WO | WO 2021/170675 | A1 | 9/2021 |

OTHER PUBLICATIONS

International Search Report and Written Opinion issued on Jul. 2, 2020 in PCT/EP2020/059684 filed on Apr. 3, 2020.
Extended European Search Report issued Jun. 30, 2023 in European Patent Application No. 23169911.7, 11 pages.
Combined Chinese Office Action and Search Report issued on Aug. 30, 2023 in Chinese Patent Application No. 202080019835.5 (with English translation), 19 pages.
Japanese Office Action issued on Aug. 28, 2023 in Japanese Patent Application No. 2021-556265 (with English translation), 7 pages.
Extended European Search Report issued Oct. 15, 2019 in European Patent Application No. 19167405.0, 7 pages.
Indian Office Action issued Jul. 31, 2023 in Indian Patent Application No. 202117030977, 6 pages.
Japanese Office Action issued Nov. 13, 2023 in Japanese Patent Application No. 2021-556265 (with English Translation), 8 pages.
Tatum, C.E., "Investigation and comparison of hardness meters", Sep. 12, 2012, 66$^{th}$ Tobacco Science Research Conference, Concord, NC, total 56 pages.

* cited by examiner

AEROSOL-GENERATING ARTICLE COMPRISING A HOLLOW TUBULAR SUPPORT ELEMENT

CROSS-REFERENCE TO RELATED APPLICATIONS

This application is a U.S. national stage application of PCT/EP2020/059684, filed on Apr. 3, 2020, which is based upon and claims the benefit of priority under 35 U.S.C. § 119 from European patent application No. 19167405.0, filed Apr. 4, 2019, the entire contents of each of which are incorporated herein by reference.

TECHNICAL FIELD

The present invention relates to aerosol-generating articles comprising an aerosol-forming substrate for generating an inhalable aerosol when heated.

DESCRIPTION OF THE RELATED ART

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in combustible cigarettes.

A combustible cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an inhalable aerosol is typically generated by the transfer of heat from a heating element to a physically separate aerosol-forming substrate or material, which may be located within, around or downstream of the heating element. During heating, volatile compounds are released from the aerosol-forming substrate and entrained in air drawn through the aerosol-generating article. For example, the volatile compounds may become entrained in air drawn through, over, around or otherwise within the vicinity of the aerosol-generating article. As the released compounds cool, they condense to form an aerosol that may be inhaled by the consumer. The aerosol may contain aromas, flavours, nicotine and other desired elements. Heating elements are normally comprised in an aerosol-generating device.

Some aerosol-generating articles are configured to be heated by an internal heating element. Internal heating elements, such as heating blades, are configured to be inserted into the aerosol-forming substrate. The internal heating element may pierce the aerosol-substrate. The internal heating element may also be received in an inner cavity of the aerosol-forming substrate. When the internal heating element generates heat, the aerosol-forming substrate is heated to a temperature at which volatile compounds are released from the substrate. The released volatile compounds cool to form an aerosol that can be inhaled by a consumer.

In aerosol-generating articles configured to be heated by an internal heating element, a support element may be included downstream of the aerosol-forming substrate. The support element is often provided in the form of an annular shaped tube of filtration material, often referred to as a hollow acetate tube. Such hollow tubular support element is configured to resist downstream movement of the aerosol-forming substrate during insertion of the heating element into the aerosol-forming substrate. The empty space within the hollow tubular support element may provide an opening for aerosol to flow from the aerosol-forming substrate towards a mouth end of the aerosol-generating article.

Hollow tubular support elements may require the presence of further elements in the aerosol-generating article. An aerosol-cooling element may be located downstream of the aerosol-forming substrate; for example, the aerosol-cooling element may be disposed immediately downstream of the support element, and may abut the support element.

As used herein, "aerosol-cooling element" refers to a component of an aerosol-generating article located downstream of the aerosol-forming substrate such that, in use, an aerosol formed by volatile compounds released from the aerosol-forming substrate passes through and is cooled by the aerosol-cooling element before being inhaled by the consumer. Preferably, the aerosol-cooling element is positioned between the aerosol-forming substrate and a mouthpiece. An aerosol cooling element has a large surface area, but causes a low pressure drop. Filters and other mouthpieces that produce a high pressure drop, for example filters formed from bundles of fibres, are not considered to be aerosol-cooling elements. Chambers and cavities within an aerosol-generating article are not considered to be aerosol cooling elements.

The existence of an aerosol-cooling element may be required in aerosol-generating articles comprising a hollow tubular support element in order to minimise the risk that the generated aerosol flowing along the opening of the hollow tubular support element reaches the downstream end—that is, the mouth end—of the aerosol-generating article with a temperature that may not suit the consumer's preferences.

The additional element may also be needed to reduce the risk of the aerosol-generating article being fragile or prone to being damaged during the consumer's experience.

However, the existence of an additional element, such as an aerosol-cooling element, may make the manufacturing of the aerosol-generating article more complex and expensive. Likewise, the additional element may be formed by crimping or by other manufacturing processes that may keep the element from being uniform in its composition or other properties. This may lead to inconsistencies in the consumer's experience.

It would therefore be desirable to provide an aerosol-generating article which is easier to manufacture and which allows for a more constant and predictable user's experience without jeopardising its robustness and the user's comfort.

SUMMARY

According to a first aspect of the present invention, an aerosol-generating article aiming at minimising one or more of the above setbacks is provided.

The aerosol-generating article may have an upstream end and a downstream end, the aerosol-generating article defining a longitudinal direction between the upstream end and the downstream end. The aerosol-generating article may comprise an aerosol-forming substrate. The aerosol-generating article may comprise a hollow tubular support element disposed downstream of the aerosol-forming substrate and extending along the longitudinal direction. The hollow tubular support element may define an opening extending in the longitudinal direction and adapted for aerosol to flow towards the downstream end. The hardness of the aerosol-generating article at the hollow tubular support element may be at least about 60%.

Preferably, the aerosol-generating article of the first aspect of the invention has an upstream end and a downstream end, the aerosol-generating article defining a longitudinal direction between the upstream end and the downstream end, the aerosol-generating article comprising:

an aerosol-forming substrate;

a hollow tubular support element disposed downstream of the aerosol-forming substrate and extending along the longitudinal direction;

wherein the hollow tubular support element defines an opening extending in the longitudinal direction and adapted for aerosol to flow towards the downstream end;

wherein the hardness of the aerosol-generating article at the hollow tubular support element is at least 60%.

According to a second inventive aspect of the invention, an aerosol-generating system is provided, the system comprising:

the aerosol-generating article as described above, and an aerosol-generating device comprising a heating element configured to be inserted into the aerosol-forming substrate of the aerosol-generating article.

The system according to the second aspect of the invention is advantageous for the same reasons as detailed above for the articles of the first aspect of the invention.

In particular, the hollow tubular support element may bear the force exerted on the aerosol-generating article when the internal heating element is inserted into the aerosol-forming substrate of the aerosol-generating article.

BRIEF DESCRIPTION OF THE DRAWINGS

These and other features and advantages of the invention will become more evident in the light of the following detailed description of preferred embodiments, given only by way of illustrative and non-limiting example, in reference to the attached figures.

DETAILED DESCRIPTION

The term "aerosol-generating article" is used herein to denote an article wherein an aerosol-forming substrate may be heated to produce and deliver an aerosol to a consumer. As used herein, the term "aerosol-generating substrate" denotes a substrate capable of releasing volatile compounds upon heating to generate an aerosol.

Figure 6:
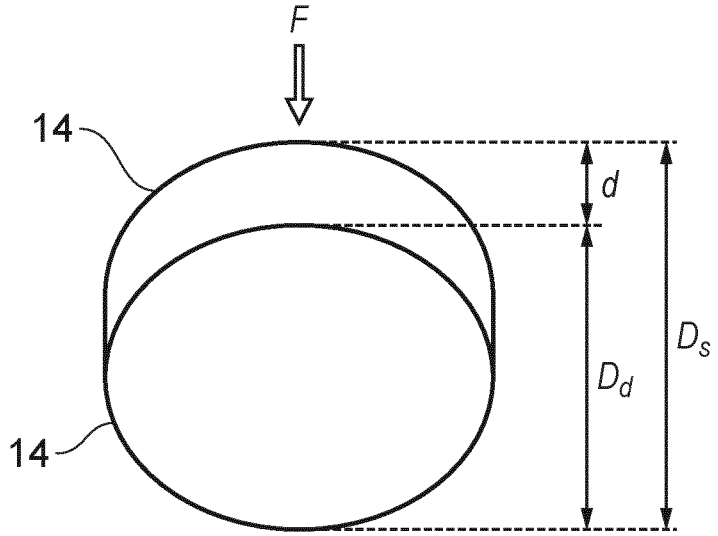
FIG. 6 illustrates a test to calculate the hardness of the hollow tubular support element.

The term "hardness" used throughout this specification denotes the resistance to deform. Hardness is generally expressed as a percentage. FIG. 6 shows an element 14 of an aerosol-generating article before applying a load F and the element whilst applying load F. The element before load F has been applied has a diameter $D_S$. The element after applying a set load for a set duration (but with the load still applied) has a (reduced) diameter $D_d$. The depression is $d=D_S-D_d$. Referring to FIG. 6, hardness is given by:

$$\text{hardness (\%)} = \frac{D_d}{D_s} * 100\%$$

where $D_S$ is the original (undepressed) cigarette diameter, and $D_d$ is the depressed diameter after applying a set load for a set duration. The harder the material, the closer the hardness is to 100%.

As is described in more detail below, and as is generally known in the art, when determining the hardness of a portion (such as a support element) of an aerosol-generating article, aerosol-generating articles should be aligned parallel in a plane and the same portion of each aerosol-generating article to be tested should be subjected to a set load for a set duration. This test is performed using a known DD60A Densimeter device (manufactured and made commercially available by Heinr. Borgwaldt GmbH, Germany).

The load is exerted using two load applying cylindrical rods, which extend across the diameter of all of the aerosol-generating articles at once. According to the standard test method for this instrument, the test should be performed such that twenty contact points occur between the aerosol-generating articles and the load applying cylindrical rods. In some cases, the support elements to be tested may be long enough such that only ten aerosol-generating articles are needed to form twenty contact points, with each aerosol-generating article contacting both load applying rods (because they are long enough to extend between the rods). In other cases, if the support elements are too short to achieve this, twenty aerosol-generating articles should be used to form the twenty contact points, with each article contacting only one of the load applying rods.

Two further stationary cylindrical rods are located underneath the aerosol-generating articles, to support the articles and counteract the load applied by each of the load applying cylindrical rods.

For the standard operating procedure for such an apparatus, an overall load of 2 kg is applied for a duration of 20 seconds. After 20 seconds have elapsed (and with the load still being applied to the aerosol-generating articles), the depression in the load applying cylindrical rods is determined, and then used to calculate the hardness from the above equation. The temperature is kept in the region of 22 degrees Centigrade±2 degrees. The test described above is referred to as the DD60A Test.

It has been found that a hardness of at least 60% at the longitudinal segment of the aerosol-generating article along which the hollow tubular support element is disposed may endow the article with the mechanical properties to withstand a standard consumer's experience even when the length of hollow tubular support element is greater than that of most prior art articles. Such hollow tubular support element may have a heat capacity to reduce the temperature of the generated aerosol flowing along the opening to a temperature which is adequate for the consumer's preferences. This can therefore allow for an aerosol-generating article in which an additional part configured to increase the robustness of the article or to cool the generated aerosol may not be required. Such aerosol-generated article may bring about a less variable experience for the consumer and may be manufactured with less production steps.

As used herein, "heat capacity" is defined as the amount of heat required to change the temperature of a substance by one degree.

The hollow tubular support element may be formed of an air-impervious material. This means that air and aerosol particles drawn through the support element during use can only flow through the opening. Because the opening has a well-defined location within the aerosol-generating article and predetermined cross-section, by adjusting the geometry of the opening it is advantageously easy to control the contribution that the hollow tubular support element makes to the overall resistance-to-draw (RTD) of the aerosol-generating article. Without wishing to be bound by theory, it is expected that such hollow tubular support element substantially does not contribute to the overall RTD of the aerosol-generating article, which ultimately depends on the RTD of the rod of aerosol-forming substrate and the RTD of other components of the aerosol-generating article.

The hardness of the aerosol-generating article at the hollow tubular support element may be between about 80% and about 90%. This range may further enhance the mechanical properties of the aerosol-generating article to resist the force of insertion of an internal heating element.

The hollow tubular support element may be disposed immediately downstream of the aerosol-forming substrate.

Since the hollow tubular support element may be configured to resist the downstream movement of the aerosol-forming substrate during insertion of the heating element into the aerosol-forming substrate, this configuration in which no intermediate parts are disposed between the aerosol-forming substrate and the support element may be beneficial to ensure the downstream movement is withstood.

The aerosol-generating article may comprise a filter disposed downstream of the hollow tubular support element in the longitudinal direction.

The term "filter" is used to indicate a section of the aerosol-generating article that is configured to remove at least partially gas phase or particulate phase constituents or both gas phase and particulate phase constituents from the mainstream aerosol drawn through the filter.

The filter may be disposed immediately downstream of the hollow tubular support element in the longitudinal direction.

As the hollow tubular support element may cool the formed aerosol to a temperature adequate for the user's preferences, the filter may be disposed immediately downstream of the hollow tubular support element, that is, without an intermediate aerosol-cooling element. Hence, the aerosol-generating article may achieve a reduction of gas and particulate phase constituents while needing less production steps and allowing a more consistent experience.

The aerosol-forming substrate may be a tobacco-containing substrate.

The aerosol-forming substrate may have a hollow tubular shape. Therefore, an internal heating element may be received in an inner cavity of the aerosol-forming substrate without piercing the substrate.

The hollow tubular support element may comprise:

a hollow tubular peripheral portion which defines an inner volume;

a longitudinal structure extending in the longitudinal direction within the inner volume;

a radial structure extending radially within the inner volume from the hollow tubular peripheral portion to the longitudinal structure, such that at least two passages are defined by the hollow tubular peripheral portion and the radial structure, the at least two passages extending in the longitudinal direction;

wherein the opening comprises the at least two passages.

In this arrangement, the hollow tubular peripheral portion and the radial structure disposed between the longitudinal structure and the hollow tubular peripheral portion form at least two passages. The passages constitute the opening that enables the aerosol to flow from the aerosol-forming substrate towards the downstream end of the article. Likewise, the longitudinal structure, the radial structure and the hollow tubular peripheral portion may also be beneficial to provide the aerosol-generating article with the required robustness and heat capacity.

The hollow tubular peripheral portion may have a substantially annular shape, which may enhance such benefits and may allow for an easier manufacturing.

The radial structure may comprise at least a first and a second flat radial walls respectively extending radially from the longitudinal structure to the hollow tubular peripheral portion.

The first and second flat radial walls may be a convenient radial structure since they may be easily manufactured and they may help achieve the desired robustness and rigidity.

The hollow tubular support element may be substantially symmetrical in a cross section thereof.

The symmetrical cross-section arrangement may also be mechanically and thermally advantageous.

The hollow tubular support element may comprise a recess adapted to house a heating element. Since an internal heater is inserted into the aerosol-forming substrate to generate aerosol, there may exist a risk that the heating element goes beyond a downstream edge of the aerosol-forming substrate, thus reaching the part of the aerosol-generating article downstream of the aerosol-forming substrate. The provision of the recess may diminish the risk of the hollow tubular support element being damaged.

The hollow tubular support element may comprise a polymer, preferably polylactic acid (PLA), cellulose acetate (CA), starch, polyhydroxyalkanoate (PHA), polypropylene (PP), polyethylene (PE), polystyrene (PS) or a combination thereof. These materials may be advantageous for the aerosol-generating article to achieve the required heat capacity in the hollow tubular support element. Polylactic acid (PLA), cellulose acetate (CA), starch, polyhydroxyalkanoate (PHA) or a combination thereof are even more preferred to achieve such required heat capacity.

The hollow tubular support element may be manufactured by additive manufacturing.

The expression "additive manufacturing" is used to refer to a manufacturing technique that is employed to sequentially deposit material to form a three-dimensional item layer by layer under computer control. This expression is typically used, in particular, to refer to three-dimensional printing (3D printing), which is the process whereby a series of layers of a material are laid down in much the same way as an inkjet printer would lay down ink, in which multiple passes of a print head will build the item. However, it shall be appreciated that a wider variety of modified additive manufacturing processes is available, including processes based on extrusion and sintering, and the expression "additive manufacturing" shall be construed as also encompassing such alternative techniques, even if, in the present application, it is particularly preferable for the additive manufacturing to be in the form of 3D printing.

The hollow tubular support element manufactured by additive manufacturing may advantageously have complex shapes. It may also be made up of a wide range of materials while keeping the costs of manufacture low. Using additive manufacturing to manufacture at least part of the hollow tubular support element may advantageously facilitate the formation of hollow tubular support elements with optimized heat capacity and structural properties.

The hollow tubular support element may be manufactured by injection moulding.

Injection moulding may be adequate to manufacture the hollow tubular support element with the intended shape, heat capacity or structural properties.

The aerosol-forming substrate may be a rod comprising a plurality of elongate tubular elements. The elongate tubular elements may contain tobacco material. By adjusting the number, equivalent diameter and thickness of the elongate tubular elements in the rod, it may be advantageously possible to adjust the density and porosity of the rod. In general, aerosol-forming substrates comprising a plurality of elongate tubular elements of homogenised tobacco may advantageously exhibit more uniform densities than aerosol-forming substrates comprising shreds of tobacco material. The geometry of the elongate tubular elements may be such that particularly stable channels are provided for airflow along the rod. This may advantageously allow a consistent fine tuning of RTD, such that aerosol-forming substrates having a predetermined RTD may be manufactured consistently and with great precision.

The weight of an aerosol-forming substrate comprising elongate tubular elements of homogenised tobacco may be determined by the number, size, density and spacing of the tubular elements. This may reduce inconsistencies in weight between aerosol-forming substrates of the same dimensions, and so result in lower rejection rate of aerosol-forming substrates whose weight falls outside of a selected acceptance range compared to aerosol-forming substrate comprising shreds of tobacco material.

Variations in the thickness of the elongate tubular elements in the rod may also be advantageously used to adjust the content of homogenised tobacco in the rod. For example, in a tubular element formed from a rolled strip of homogenised tobacco web an adjustment of the thickness of the tubular element may be achieved by varying the number of convolutions of the strip about the longitudinal axis or by varying the thickness of the homogenised tobacco web itself. This may impart an increased design flexibility compared with aerosol-generating articles comprising shreds of tobacco material.

The size, geometry and arrangement of the elongate tubular elements in the rod may be readily adapted to facilitate the insertion of a heating element in the rods of aerosol-generating articles. Because the tubular elements lie substantially straight within the rod and extend longitudinally, insertion of a longitudinally extending internal heating element, such as a heater blade, may be facilitated. The regular arrangement of the elongate tubular elements in the rod can also advantageously favour optimisation of heat transfer from the heating element through the rod.

The insertion (and removal) of a heater element of an aerosol-generating device into (from) an aerosol-forming substrate comprising shreds of tobacco material may tend to dislodge shreds of tobacco material from the aerosol-forming substrate. This can disadvantageously result in the need for more frequent cleaning of the heater element and other parts of the aerosol-generating device in order to remove the dislodged shreds. In contrast, insertion and removal of a heater element of an aerosol-generating device into and from an aerosol-forming substrate comprising a plurality of elongate tubular elements of homogenised tobacco material may advantageously have a significantly reduced tendency to dislodge material.

Rods comprising a plurality of elongate tubular elements may be made in a continuous process which can be efficiently carried out at high speed, and can be conveniently incorporated into existing production lines for the manufacture of aerosol-generating articles.

The rod of aerosol-forming substrate preferably has an external diameter that is approximately equal to the external diameter of the aerosol-generating article.

The rod of aerosol-forming substrate may have an external diameter of at least 5 millimetres. The rod of aerosol-forming substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol-forming substrate may have an external diameter of 7.2 millimetres, to within 10 percent.

The rod of aerosol-forming substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 80 millimetres, more preferably less than about 65 millimetres, even more preferably less than about 50 millimetres. In particularly preferred embodiments, the rod of aerosol generating substrate has a length of less than about 35 millimetres, more preferably less than 25 millimetres, even more preferably less than about 20 millimetres. The rod of aerosol-forming substrate may have a length of about 10 millimetres; the rod of aerosol-forming substrate may have a length of about 12 millimetres.

The rod of aerosol-forming substrate may have a substantially uniform cross-section along the length of the rod. The rod of aerosol-forming substrate may preferably have a substantially circular cross-section.

The rod comprising elongate tubular elements may be circumscribed by a wrapper. The elongate tubular elements may be assembled such that the elongate tubular elements extend in the longitudinal direction.

As used herein, the term "rod" is used to denote a generally cylindrical element of substantially circular, oval or elliptical cross-section.

The plurality of elongate tubular elements of the rod of aerosol-generating articles according to the invention may be formed of a homogenous tobacco material, which may comprise particulate tobacco obtained by grinding. The plurality of elongate tubular elements may all have substantially the same composition as each other. Alternatively, the plurality of elongate tubular elements may include tubular elements of at least two different compositions.

At least one elongate tubular element in the rod may comprise a rolled strip cut from a sheet or web of homogenised tobacco material.

The sheets or webs of homogenised tobacco material may have a tobacco content of at least about 40 percent by weight on a dry weight basis, more preferably of at least about 60 percent by weight on a dry weight basis, more preferably or at least about 70 percent by weight on a dry basis and most preferably at least about 90 percent by weight on a dry weight basis.

The sheets or webs of homogenised tobacco material for use in the aerosol-forming substrate may comprise one or more intrinsic binders, that is, tobacco endogenous binders, one or more extrinsic binders, that is, tobacco exogenous binders, or a combination thereof to help agglomerate the particulate tobacco. Alternatively, or in addition, sheets of homogenised tobacco material for use in the aerosol-forming substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets or webs of homogenised tobacco material for use in the aerosol-forming substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets or webs of homogenised tobacco material for use in the aerosol-forming substrate are known in the art and include, but are not limited to: cellulose fibers; soft-wood fibres; hard-wood fibres; jute fibres and combinations thereof. Prior to inclusion in sheets of homogenised tobacco material for use in the aerosol-forming substrate, non-tobacco fibres may be treated by suitable processes known in the art including, but not limited to: mechanical pulping; refining; chemical pulping; bleaching; sulfate pulping; and combinations thereof.

The sheets or webs of homogenised tobacco material may comprise an aerosol former. As used herein, the term "aerosol former" describes any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The sheets or webs of homogenised tobacco material may comprise a single aerosol former. Alternatively, the sheets or webs of homogenised tobacco material may comprise a combination of two or more aerosol formers.

The sheets or webs of homogenised tobacco material may have an aerosol former content of greater than 5 percent on a dry weight basis. The sheets of homogenised tobacco material may have an aerosol former content of between approximately 5 percent and approximately 30 percent on a dry weight basis. In a preferred embodiment, the sheets of homogenised tobacco material have an aerosol former content of approximately 20 percent on a dry weight basis.

The sheets or webs of homogenised tobacco for use in the aerosol-generating article of the present invention may be made by methods known in the art, for example the methods disclosed in international patent application WO-A-2012/164009 A2. The sheets of homogenised tobacco material for use in the aerosol-generating article may be formed from a slurry comprising particulate tobacco, guar gum, cellulose fibres and glycerine by a casting process.

As an alternative, elongate tubular elements of homogenised tobacco material for use in an aerosol-forming substrate in accordance with the invention may be formed by extrusion. By way of example, a slurry comprising particulate tobacco obtained by grinding or otherwise comminuting tobacco leaf lamina may be pushed through a die of the desired cross-section. As a further alternative, additive manufacturing may also be used for manufacturing tubular elements of homogenised tobacco material.

The elongate tubular element may have an equivalent diameter from about 0.03 millimetres to about 3 millimetres. Preferably, the elongate tubular element may have an equivalent diameter of at least about 0.1 millimetres. More preferably, the elongate tubular element may have an equivalent diameter of at least about 0.3 millimetres.

In addition, or as an alternative, the elongate tubular element preferably may have an equivalent diameter of less than about 2 millimetres. More preferably, the elongate tubular element may have an equivalent diameter of less than about 1 millimetre.

The elongate tubular element may have an equivalent diameter from about 0.7 millimetres to about 2.7 millimetres; the elongate tubular element may have an equivalent diameter from about 0.3 millimetres to about 1.1 millimetres.

Where the tubular element is formed by rolling a strip of homogenised tobacco material, the strip may have a width of at least about 1 millimetre. Preferably, the strip of homogenised tobacco material may have a width of at least about 2 millimetres. More preferably, the strip of homogenised material may have a width of at least about 3 millimetres.

The strip of homogenised tobacco material may have a width from about 1 millimetre to about 3.5 millimetres; the strip of homogenised tobacco material may have a width from about 2.4 millimetres to about 8.2 millimetres.

The strip of homogenised tobacco material may cut from a sheet or web having a thickness of at least about 40 microns, more preferably at least about 60 microns, more preferably at least about 80 microns and most preferably at least about 100 microns. Alternatively or in addition, the strip of homogenised tobacco material may be cut from a sheet or web having a thickness of no more than about 5000 microns, more preferably no more than about 2000 microns, more preferably no more than about 1000 microns and most preferably no more than about 500 microns. For example, the thickness of the sheet or web may be between about 40 microns and about 5000 microns, more preferably between about 60 microns and about 2000 microns, more preferably between about 80 microns and about 1000 microns, and most preferably by between about 100 microns and about 500 microns.

A thickness of the elongate tubular element may be at least about 40 microns, more preferably at least about 80 microns, more preferably at least about 120 microns and most preferably at least about 160 microns. In addition or as an alternative, a thickness of the elongate tubular element may be less than about 5000 microns, more preferably less than about 2500 microns, and most preferably less than about 1000 microns.

The tubular elements may be formed of a porous tobacco material, such that air flows through the wall of the tubular element; that is, airflow along a substantially radial direction in the rod is not impeded. Where the tubular element is formed by rolling a strip of homogenised tobacco material the strip itself may be formed of a porous tobacco material.

As used herein with reference to a homogenised tobacco material, the term "porous" may indicate that the tobacco material has been produced within an inherent porosity so that sufficient pores or interstices are provided within the structure of a sheet or web such as to enable the flow of air through the sheet or web in a direction transverse to a surface of the sheet or web. Alternatively or in addition, the term "porous" may indicate that each sheet or web of tobacco material comprises a plurality of air flow holes to provide the desired porosity. For example, a sheet of tobacco material may be punctured with a pattern of air flow holes prior to undergoing the rolling operation that produces the elongate tubular elements of the rod of aerosol-forming substrate. The air flow holes may be punctured randomly or uniformly over the sheet. The pattern of air flow holes may cover substantially the full surface of the sheet, or may cover one or more specific areas of the sheet, with the remaining areas being free from air flow holes.

The strip of homogenised tobacco material from which the elongated tubular element may be formed may be textured. As used herein the term "textured" refers to a sheet or web that has been crimped, embossed, debossed, perforated or otherwise locally deformed. For example, the sheet or web from which the strip is cut may comprise a plurality of spaced-apart indentations, protrusions, perforations or a combination thereof. Texture may be provided on one side of each sheet, or on both sides of each sheet.

As used herein, the term "crimped" denotes a sheet or web or part thereof having a plurality of substantially parallel ridges or corrugations. The inclusion of one or more tubular elements formed from a crimped strip may help to provide and retain some spacing between adjacent tubular elements within the rod.

Alternatively or in addition to the provision of texture on the surface of at least one of the plurality of tubular elements, an additive may be applied to at least a part of a surface of at least one of the plurality of tubular elements. The additive may be a solid additive, a liquid additive, or a combination of a solid additive and a liquid additive. Suitable solid and liquid additives for use in the invention are known in the art and include, but are not limited to: flavourants, such as for example menthol; adsorbents, such as for example activated carbon; fillers, such as for example calcium carbonate; and botanical additives.

To form a substantially tubular element, the strip of homogenised tobacco material may be wound about the longitudinal axis by at least about 345 degrees. Preferably, the strip of homogenised tobacco material is wound about the longitudinal axis by at least about 360 degrees. More preferably, the strip of homogenised tobacco material is wound about the longitudinal axis by at least about 540 degrees. In addition, or as an alternative, the strip of homogenised tobacco material is preferably wound about the longitudinal axis by less than about 1800 degrees. More preferably, the strip of homogenised tobacco material is wound about the longitudinal axis by less than about 900 degrees. In some preferred embodiments, the strip of homogenised tobacco material is wound about the longitudinal axis by from about 345 to about 540 degrees.

Each elongate tubular element may have a length substantially equal to the length of the rod of aerosol-forming substrate. Each tubular element may have a length of about 10 millimetres; each tubular element may a length of about 12 millimetres.

The rod of aerosol-forming substrate may comprise less than about 200 elongate tubular elements of homogenised tobacco material. More preferably, the rod of aerosol-forming substrate comprises less than about 150 tubular elements. Even more preferably, the rod of aerosol-forming substrate comprises less than about 100 tubular elements.

In addition, or as an alternative, the rod of aerosol-forming substrate may comprise at least about 15 tubular elements of homogenised tobacco material. More preferably, the rod of aerosol-forming substrate comprises at least about 30 tubular elements. Even more preferably, the rod of aerosol-forming substrate comprises at least about 40 tubular elements. The rod of aerosol-forming substrate may comprise from about 15 to about 100 strands of non-tobacco material.

In the rod of the aerosol-forming substrate the elongate tubular elements may be aligned substantially parallel to one another.

The elongate tubular elements of homogenised tobacco material may have substantially oval cross-section; they may have a substantially elliptical transverse cross-section; they may a substantially circular transverse cross-section. As described above, tubular elements for use in aerosol-generating articles may effectively be formed by winding a strip of homogenised tobacco material about its longitudinal axis by slightly less than 360 degrees. This results in an element having effectively a C-shaped cross-section, wherein a slit extends longitudinally over the entire length of the tubular element.

The plurality of elongate tubular elements forming the rod of aerosol-forming substrate may be circumscribed by a wrapper. The wrapper may be formed of a porous or non-porous sheet material. The wrapper may be formed of any suitable material or combination of materials. The wrapper may be a paper wrapper. The wrapper may optionally be adhered to the outer edges of the plurality of tubular elements. For example, at least one of the inner surface of the wrapper and the outer edges of the plurality of tubular elements may be wetted during the production process such that the inner wrapper adheres to the edges of the tubular elements during the wrapping process. Alternatively, an adhesive may be applied to at least one of the inner surface of the wrapper and the outer edges of the plurality of tubular elements upstream of the wrapping step. The adhesion of the plurality of tubular elements and the wrapper may advantageously help to retain the position and spacing of the plurality of tubular elements within the rod.

The wrapper may be at least partially folded over the tubular elements at the upstream and downstream ends of the rod to retain the plurality of tubular elements within the rod. The wrapper may overlie the periphery of the plurality of tubular elements at the upstream and downstream ends of the rod so that the remainder of the tubular elements is exposed. The wrapper may overlie the entire upstream and downstream ends of the rod.

As an alternative to folding the ends of the wrapper over the upstream and downstream ends of the tubular elements, a separate rim section of paper or other material may be attached to the wrapper to overlie at least the periphery of the upstream and downstream ends of the tubular elements, as described above. When the wrapper is folded over the ends of the rod, or where a separate rim section is provided, an additional outer wrapper may be provided overlying the wrapper that circumscribes the plurality of tubular elements.

A rod for use in an aerosol-generating article as described above may be manufactured by a method as set out below. In a first step of the method, there may be provided a sheet or web of homogenised tobacco material. In a second step, an elongate strip having a longitudinal axis may be cut from the sheet or web of homogenised tobacco material. The cutting operation may be carried out by feeding the sheet or web from a roll or bobbin and by moving it in continuous fashion along a predetermined direction. Cutting means may be provided at a cutting station to which the web or sheet is fed. To this purpose, mechanical cutters may be used. As an alternative, lasers can also be used.

In a third step, the strip may be rolled, that is, wound about the longitudinal axis to form an elongate substantially tubular element. This may be achieved by feeding the strip along a predetermined direction to a funnel shaped element, such that the strip is coiled and shaped into a rolled substantially tubular element. Several individual rolled substantially tubular elements may be manufactured in parallel.

In a fourth step, a plurality of elongate substantially tubular element obtained at the end of the third step may be collated and assembled such that the elongate tubular elements extend in the longitudinal direction. This may be achieved by feeding the plurality of elongate substantially tubular elements through another funnel element such that they are grouped in a substantially cylindrical cluster.

In a fifth step, the assembled tubular elements may be circumscribed with a wrapper to form a continuous rod. In a sixth step, the continuous rod may be severed into a plurality of discrete rods.

This method may comprise a further step of applying at least one aerosol former to the sheet or web of homogenised material prior to the step of cutting the sheet or web to obtain the strip. The method may alternatively comprise a further step of applying at least one aerosol former to the elongate tubular elements prior to the step of collating and assembling the plurality of elongate tubular members.

In one further alternative, the method may comprise a further step of applying at least one aerosol former to the plurality of elongate tubular elements after they have been collated and assembled. As one additional alternative, the method may comprise a step of applying at least one aerosol former to the plurality of elongate tubular elements following the step of severing the continuous rod into discrete rods.

The method may further comprise a step of drying the homogenised tobacco material after the step of applying the at least one aerosol former.

According to a second inventive aspect of the invention, an aerosol-generating system is provided, the system comprising:

the aerosol-generating article as described above, and an aerosol-generating device comprising a heating element configured to be inserted into the aerosol-forming substrate of the aerosol-generating article.

The system according to the second aspect of the invention is advantageous for the same reasons as detailed above for the articles of the first aspect of the invention.

In particular, the hollow tubular support element may bear the force exerted on the aerosol-generating article when the internal heating element is inserted into the aerosol-forming substrate of the aerosol-generating article.

The internal heating element may be a blade shaped heating element configured to pierce the aerosol-forming substrate. Alternatively, a hollow tubular aerosol-forming substrate can be provided, the hollow tubular aerosol-forming substrate defining an inner cavity in which the internal heating element can be inserted. The internal heating element may be electrically connected to a power supply. When the heating element receives electrical power from the power supply and is inserted into the aerosol-forming substrate, the aerosol-forming substrate is heated to a temperature at which an aerosol is formed.

The formed aerosol flows along the opening defined by the hollow tubular support element, which may cool the aerosol to a temperature suitable for the consumer's preferences before the aerosol reaches the downstream end, through which the consumer may inhale the aerosol.

As used herein, the term "aerosol-generating device" refers to a device comprising a heating element that interacts with the aerosol-forming substrate of the aerosol-generating article to generate an aerosol.

Figure 1:
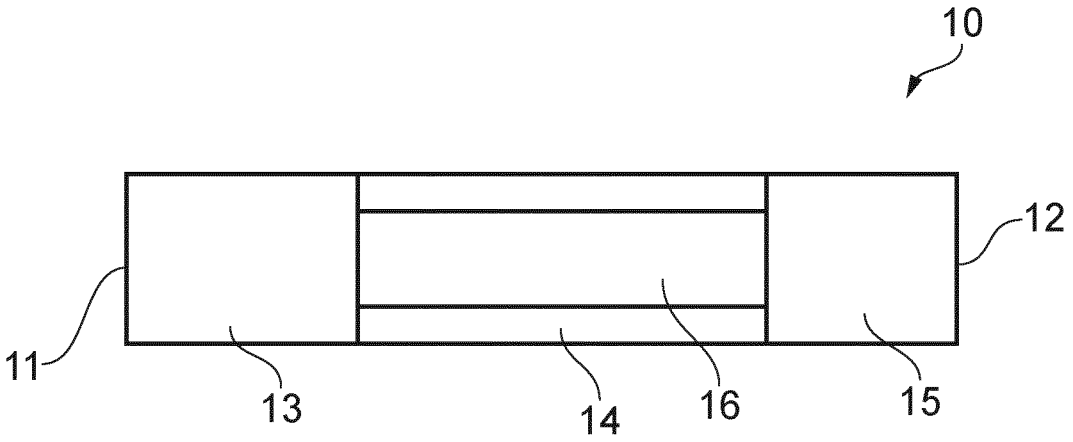
FIG. 1 depicts a longitudinal section of an aerosol-generating article comprising a hollow tubular support element.

FIG. 1 depicts a longitudinal section of an aerosol-generating article 10 having an upstream end 11 and a downstream end 12, the aerosol-generating article 10 defining a longitudinal direction between the upstream end 11 and the downstream end 12. The article 10 comprises an aerosol-forming substrate 13. In the embodiment of FIG. 1, a hollow tubular support element 14 is disposed immediately downstream of the aerosol-forming substrate 13 and extending along the longitudinal direction. The hollow tubular support element 14 defines an opening 16 extending in the longitudinal direction and adapted for aerosol to flow towards the downstream end 12.

In the embodiment of FIG. 1, a filter 15 is disposed immediately downstream of the hollow tubular support element 14 in the longitudinal direction.

The hardness of the aerosol-generating article 10 at the hollow tubular support element 14 is at least about 60% and, preferably, between about 80% and about 90%.

The aerosol-generating article 10 of FIG. 1 may attain a desired reduction of certain constituents, due to the effect of the filter 15, and may have the desired properties in terms of structural resistance and heat capacity by providing the hollow tubular support element 14, without necessarily comprising a further aerosol-cooling element or an additional support element. Therefore, the aerosol-generating article 10 may be more easily manufactured and may avoid the disadvantages that aerosol-cooling elements or the like may lead to, such as an inconsistent experience for the consumer.

Figure 2:
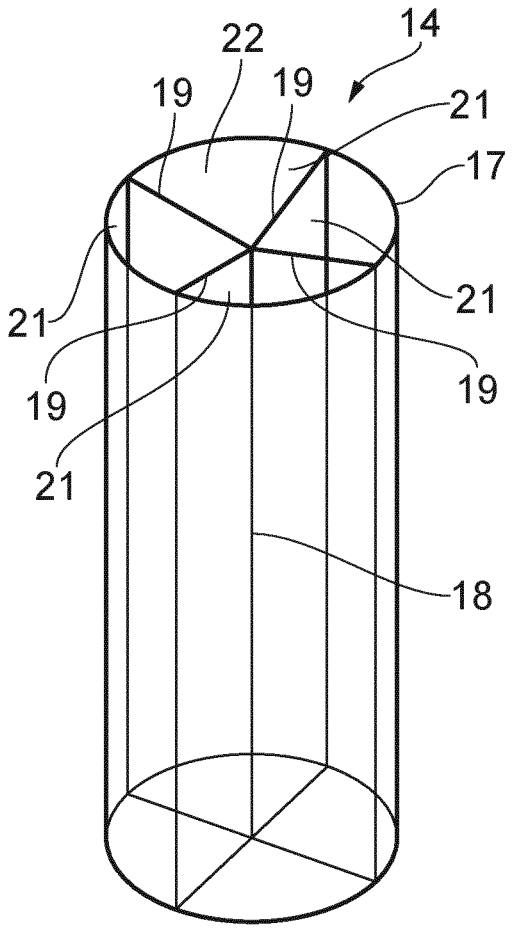
FIG. 2 illustrates a hollow tubular support element comprising four flat radial walls.

FIG. 2 depicts a hollow tubular support element 14 comprising a substantially annular hollow tubular peripheral portion 17 which defines an inner volume. A longitudinal structure 18 extends in the longitudinal direction within the inner volume. In the embodiment of FIG. 2, a radial structure formed of four flat radial walls 19 extends radially from the hollow tubular peripheral portion 17 to the longitudinal structure 18. Four passages 21 are defined between the hollow tubular peripheral portion 17 and the four flat radial walls 19, the four passages 21 extending in the longitudinal direction. The four passages 21 form the opening along which the formed aerosol may flow towards the downstream 12 end of the aerosol-generating article 10.

Figure 3:
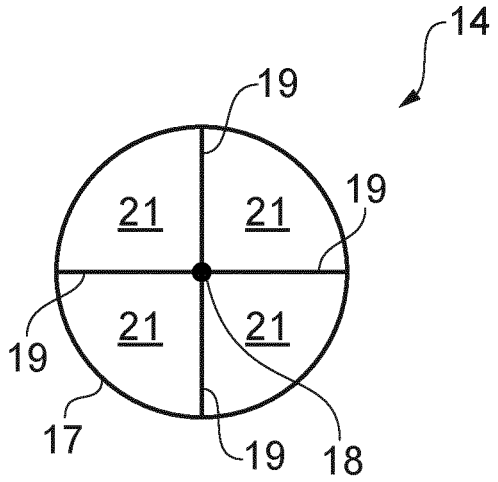
FIG. 3 illustrates a cross-section of the hollow tubular support element of FIG. 2.

FIG. 3 represents a cross-section of the embodiment of FIG. 2. The hollow tubular support element 14 of this embodiment is substantially symmetrical according to such cross section, as is depicted in FIG. 3. The longitudinal structure 18 is disposed along the longitudinal axis of the annular hollow tubular peripheral portion 17. In the embodiment of FIG. 3, each flat radial wall 19 is separated from the adjacent flat radial wall 19 by 90°. Therefore, according to the cross-section of FIG. 3, each of the four passages 21 forms a quarter of a circle.

Figure 4:
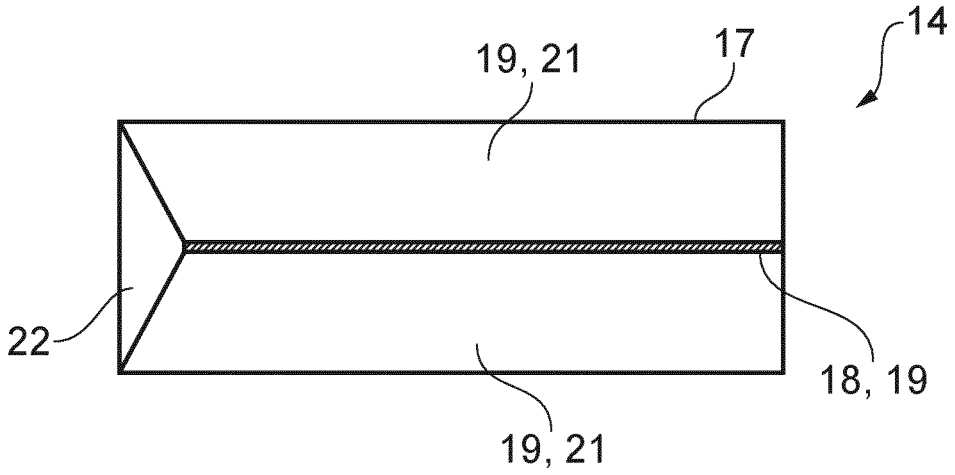
FIG. 4 illustrates a longitudinal section of the hollow tubular support elements of FIG. 2.

FIG. 4 shows a longitudinal section of the embodiments of FIGS. 2 and 3, such section containing the longitudinal structure 18 and two of the four flat radial walls 19. In this figure, a recess 22 present in the hollow tubular support element 14 of this embodiment can be more clearly appreciated than in FIGS. 2 and 3. The recess 22 is configured to house the heating element 31 of an aerosol-generating device 30, which may reduce the risk of the hollow tubular support element 14 being damaged by the heating element 31.

Figure 5:
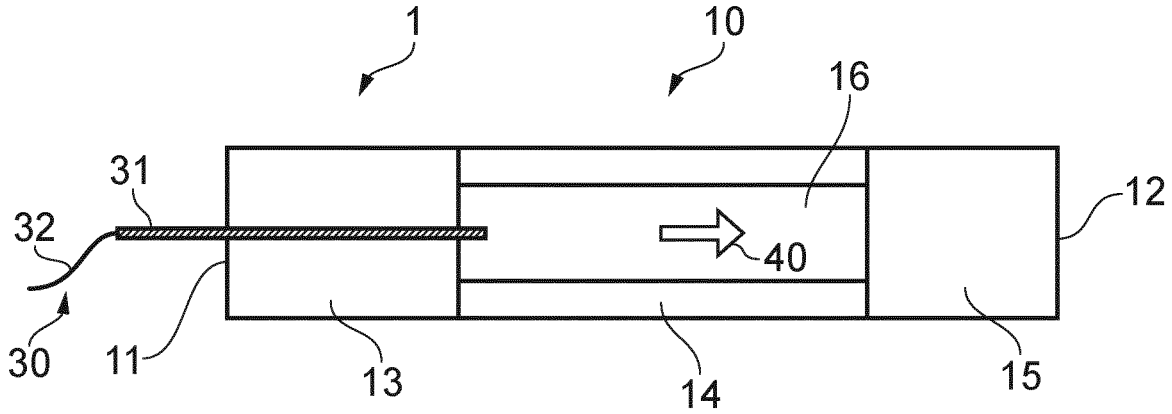
FIG. 5 represents an aerosol-generating system comprising an aerosol-generating article and an aerosol-generating device in turn comprising an internal heating element.

FIG. 5 depicts an aerosol-generating system 1 comprising the aerosol-generating article 10 of FIG. 1 and an aerosol-generating device 30 comprising a heating element 31 inserted into the aerosol-forming substrate 13 of the aerosol-generating article 10. More concretely, the heating element 31 of the system of FIG. 5 is a blade-shaped internal heating element 31 that pierces the aerosol-forming substrate 13. A power supply 32 is arranged to provide electrical power to the heating element 31. When the heating element 31 pierces the aerosol-forming substrate 13, as shown in FIG. 5, and the heating element 31 receives electrical power, thus generating heat, the aerosol-forming substrate 13 is heated to a temperature at which an aerosol 40 that can be inhaled by a consumer is formed. The hollow tubular support element 14 may increase the resistance of the aerosol-generating article 10 to withstand the forces generated when the heating element 31 is inserted into the aerosol-forming substrate 13. Likewise, the hollow tubular support element 14 may sufficiently cool the formed aerosol 40 when the aerosol flows along the opening 16 so that it reaches the filter 15 with a temperature which is adequate for the consumer's preferences. The cooled aerosol 40 flows through the filter 15 and reaches the downstream end 12 of the aerosol-generating article through which the consumer inhales the aerosol 40.

The invention claimed is:

1. An aerosol-generating article having an upstream end and a downstream end, the aerosol-generating article defining a longitudinal direction between the upstream end and the downstream end, the aerosol-generating article comprising:

an aerosol-forming substrate;

a hollow tubular support element disposed downstream of the aerosol-forming substrate and extending along the longitudinal direction, wherein the hollow tubular support element defines an opening extending in the longitudinal direction and configured for aerosol to flow towards the downstream end, a filter disposed downstream of the hollow tubular support element in the longitudinal direction, wherein a hardness of the aerosol-generating article at the hollow tubular support element is at least about 80%; and wherein the hardness of the aerosol-generating article at the hollow tubular support element is determined by means of the DD60A Test.

2. The aerosol-generating article according to claim 1, wherein the hardness of the aerosol-generating article at the hollow tubular support element is equal to or lower than about 90%.

3. The aerosol-generating article according to claim 1, wherein the hollow tubular support element is disposed immediately downstream of the aerosol-forming substrate.

4. The aerosol-generating article according to claim 1, wherein the filter is disposed immediately downstream of the hollow tubular support element in the longitudinal direction.

5. The aerosol-generating article according to claim 1, wherein the aerosol-forming substrate is a tobacco-containing substrate.

6. The aerosol-generating article according to claim 1, wherein the aerosol-forming substrate has a hollow tubular shape.

7. The aerosol-generating article according to claim 1, wherein the hollow tubular support element comprises:

a hollow tubular peripheral portion, which defines an inner volume, a longitudinal structure extending in the longitudinal direction within the inner volume, and a radial structure extending radially within the inner volume from the hollow tubular peripheral portion to the longitudinal structure, such that at least two passages are defined by the hollow tubular peripheral portion and the radial structure, the at least two passages extending in the longitudinal direction, and wherein the opening comprises the at least two passages.

8. The aerosol-generating article according to claim 7, wherein the hollow tubular peripheral portion is substantially annular shaped.

9. The aerosol-generating article according to claim 7, wherein the radial structure comprises at least a first flat radial wall and a second flat radial wall extending radially from the longitudinal structure to the hollow tubular peripheral portion.

10. The aerosol-generating article according to claim 1, wherein the hollow tubular support element is substantially symmetrical in a cross section thereof.

11. The aerosol-generating article according to claim 1, wherein the hollow tubular support element comprises a recess configured to house a heating element.

12. The aerosol-generating article according to claim 1, wherein the hollow tubular support element comprises a polymer.

13. The aerosol-generating article according to claim 12, wherein the polymer is polylactic acid (PLA), cellulose acetate (CA), starch, polyhydroxyalkanoate (PHA), polypropylene (PP), polyethylene (PE), polystyrene (PS), or a combination thereof.

14. The aerosol-generating article according to claim 1, wherein at least a part of the hollow tubular support element is manufactured by additive manufacturing or is injection molded.

15. An aerosol-generating system, comprising:

the aerosol-generating article according to claim 1, and an aerosol-generating device comprising a heating element configured to be inserted into the aerosol-forming substrate of the aerosol-generating article.

* * * * *